US005882724A

United States Patent [19]

Rourke et al.

[11] Patent Number: 5,882,724

[45] Date of Patent: Mar. 16, 1999

[54] INK JET APPLICATION OF HOT MELT STILTS TO CARBONLESS PAPER

[75] Inventors: John K. Rourke, Chillicothe; William J. Culhane, Dayton, both of Ohio

[73] Assignee: The Mead Corporation, Dayton, Ohio

[21] Appl. No.: 841,461

[22] Filed: Apr. 22, 1997

[51] Int. Cl.[6] ..... B41M 3/12

[52] U.S. Cl. ..... 427/150; 427/151; 427/152; 427/265; 427/288; 427/326; 427/411; 427/416; 427/391

[58] Field of Search ..... 427/150–152, 427/265, 288, 326, 411, 416, 391

[56] References Cited

U.S. PATENT DOCUMENTS

| | | | |
|---|---|---|---|
| Re. 34,029 | 8/1992 | Ball | 346/1.1 |
| 4,097,619 | 6/1978 | Davis et al. . | |
| 4,112,138 | 9/1978 | Davis et al. . | |
| 4,139,392 | 2/1979 | Davis et al. | 106/14.5 |
| 4,143,890 | 3/1979 | Davis et al. | 282/27.5 |
| 4,162,165 | 7/1979 | Schwab | 106/21 |
| 4,203,619 | 5/1980 | Sanders | 282/27.5 |
| 4,931,920 | 6/1990 | Barker | 363/82 |
| 5,185,035 | 2/1993 | Brown et al. | 106/31 |
| 5,223,860 | 6/1993 | Loofbourow et al. | 346/140 |
| 5,286,288 | 2/1994 | Tobias et al. | 106/20 |
| 5,350,446 | 9/1994 | Lin et al. | 706/27 |
| 5,409,530 | 4/1995 | Kanbayashi et al. | 106/27 |
| 5,514,209 | 5/1996 | Larson, Jr. | 106/30 |

*Primary Examiner*—Janyce Bell
*Attorney, Agent, or Firm*—Thompson Hine & Flory LLP

[57] ABSTRACT

The present invention is directed to a method of preparing a carbonless paper by ink jet application of molten particles before or after application of capsules.

12 Claims, No Drawings

INK JET APPLICATION OF HOT MELT STILTS TO CARBONLESS PAPER

BACKGROUND OF THE INVENTION

The present invention relates generally to a method for preparing carbonless paper in which particles of a hot melt composition are applied to the surface of pressure sensitive carbonless transfer sheets to prevent the microcapsules from being prematurely or inadvertently ruptured. In accordance with the preferred embodiment of the invention, the particles are applied using an ink jet.

Hot melt inks have been used in ink jet printing applications where high quality color prints having sharply defined images of high resolution and superior edge definition are desired. See, e.g., U.S. Pat. No. 5,223,860 to Lofbourow et al; U.S. Pat. No. 5,350,446 to Lin et al; U.S. Pat. No. 5,409,530 to Kamboyashi et al; U.S. Pat. No. 5,514, 209 to Larson, Jr.; and U.S. Pat. No. Re. 34,029 to Ball. Brown et al. in U.S. Pat. No. 5,185,035 teaches the use of a transparent hot melt inks to make color reproductions on paper or overhead projection transparencies where highly transparent colored inks are necessary.

Hot melt materials also have been used in carbonless coating compositions as a vehicle or suspending medium for pigment particles and/or encapsulated chromogenic materials as discussed in commonly assigned U.S. Pat. Nos. 4,097,619; 4,139,392; 4,143,890; and 4,162,165.

Carbonless transfer sheets, to which the present invention is particularly directed, have been commercially available for many years. One type of carbonless transfer sheet is known as a CB (coated back) sheet. The backside of a CB sheet is coated with a layer of microcapsules. CB sheets are assembled with sheets known as CF sheets in which the front side of the sheet is coated with a composition containing one or more color developers. When a CF sheet and a CB sheet are assembled so that the CB coating faces the CF coating, and sufficient pressure is applied in a predetermined configuration, such as by writing, the capsules in the CB sheet rupture and release the color precursor which is then transferred to the CF sheet where it reacts with the color developer to form an image. Another sheet known as a CFB sheet is coated on one side with microcapsules and the other side with developer and can be interleaved between a CB and a CF sheet to provide a multipart form.

Another type of carbonless transfer sheet is a self-contained paper in which only one side of the paper is coated with both the color precursor, in encapsulated form, and the color developer in a single coating. Thus, when pressure is applied, the color precursor capsule is ruptured and color precursor is released where it reacts with the surrounding color developer to form an image on an adjacent imaging sheet. As can be appreciated, both of these forms of carbonless sheets are extremely sensitive to minute pressure and subject to premature random development during routing handling of the sheets.

In order to prevent premature and inadvertent rupture of the microcapsules during manufacture and handling, it is common practice to incorporate stilt particles such as starch granules into the capsule coating mixture prior to its application to the paper. See for example, U.S. Pat. No. 4,931,920 to Asamo et al., in which stilt materials such as wheat starch, potato starch, cellulose starch and various synthetic resin particles are used to prevent microcapsules from being broken. The stilt particles, being larger than the capsules, protect the capsules from being prematurely ruptured by pressures associated with normal handling of the sheets and manufacturing operations.

SUMMARY OF THE INVENTION

This invention relates to a method for producing carbonless paper comprising applying stilts to a carbonless transfer paper substrate by forming particles of a hot melt composition and depositing the particles on the substrate such that they solidify and adhere to the substrate, wherein the substrate is coated with a layer of capsules prior to or subsequent to depositing the particles of the hot melt composition onto the substrate. The hot melt composition typically has a melting point of about 60° to 175° C. and a viscosity of about 0.2 to 20 centipoises at the application temperature. The invention also relates to the pressure sensitive carbonless transfer paper produced thereby. The inert hot melt stilt particles form a network of structures which extend above the surface of the paper to a height at least equal to the capsules. These stilt particles thus protect the capsules from being inadvertently ruptured.

In one embodiment of this invention, the hot melt stilts are applied by an ink jet applicator to the carbonless paper prior to the capsule application. In another embodiment of the invention, the hot melt stilts are applied by an ink jet applicator to the carbonless paper subsequent to the capsules application.

DETAILED DESCRIPTION OF THE INVENTION

In accordance with the present invention, ink jet printing technology is used to provide effective hot melt stilting to a capsule-bearing surface of various carbonless copy papers. The term "carbonless paper" as used herein shall be understood to encompass any of the types of image transfer paper employing encapsulated chromogenic materials as discussed above, and the term "chromogenic material" means a color forming material such as a color precursor.

The hot melt stilt compositions useful in the practice of the present invention should be solid at temperatures below about 50° C. and readily flowable at the application temperature. The hot melt compositions should exhibit excellent adhesion to the carbonless substrate, have good scratch resistance and rub resistance, and sufficient strength to withstand the pressures typically encountered during handling which would inadvertently and prematurely rupture the chromogenic material-containing capsules. Typically, an ink jet printing system, when used in accordance with the present invention, provides for the deposition of a plurality of hot melt particles having an average diameter of about 15 to 100 microns and preferably about 40 to 80 microns. The composition of the particles should be such that the particles stick to the surface of the carbonless substrate and provide a raised area which is hard enough that it protects the microcapsules from inadvertent rupture.

Generally, the hot melt compositions of the present invention have a melting point of about 60° C. to 175° C., preferably about 70° C. to 150° C. and most preferably about 80° C. to 125° C. Relative to the melting point, the hot melt composition should have a narrow melting range whereby the composition sets up rapidly after application to the carbonless paper substrate. More particularly, a practical melting range limitation in which the hot melt composition of the present invention changes from a molten state to a solid state is about 1.0° C. to about 15° C. The preferred setting time is from about 0.5 seconds to about 5 seconds, preferably, about 0.5 seconds to about 2 seconds. Generally, the molten stilt composition will harden immediately upon being deposited on the carbonless paper substrate; however, in some instances depending on the setting time of the particular hot melt composition used, it may be desirable to apply the molten stilt composition to the substrate as the substrate passes over a chill roll to speed up the hardening of the molten stilt material.

The hot melt compositions of the present invention must have a sufficiently low viscosity in the molten state in order to allow the ink jet printer applicator to effectively and efficiently form and apply the droplets of molten composition onto the carbonless paper substrate. In general, it is desirable that the hot melt composition have a viscosity in the molten stage of 0.2 to 20 centipoises and most preferably from about 1 to 10 centipoises at the application temperature.

The hot melt compositions useful in the present invention can be selected from a wide range of hot melt compositions available commercially for use in ink jets. Such hot melt compositions include natural or synthetic resins, high molecular weight organic compounds having a functional group, natural or synthetic waxes, or mixtures thereof. Representative examples of useful hot melt compositions include fatty acids, and alcohols, esters, amides, etc. having up to about 24 carbon atoms or more, preferably about 18 to 24 carbon atoms of which stearic acid and behenic acid are representative examples; hydrocarbon polymers and copolymers such as polyethylene, polypropylene, polystyrene, ethylene-vinyl acetate copolymer, and the like; aliphatic amide waxes, e.g., stearamide wax, behenamide wax, and bis-stearamide wax; fatty acid waxes; hydroxylated fatty acid waxes; oxazoline waxes; amine waxes; vegetable waxes such as carnauba wax and castor wax; polyethylene waxes; synthetic paraffin waxes; microcrystalline waxes; modified microcrystalline waxes; deresinated, oxidized mineral waxes such as montan waxes; and mixtures thereof. Other suitable waxes include, bamboo leaf, certain bees waxes, caranda, chinese insect, cotton, cranberry, certain Douglas-fir bark, asparto, certain flax, Indian corn, Madagascar, ouricery, ozocerite, palm, peat, rice bran, shallas, sisal hemp, sorghum grain, spanish moss, refined sugar cane, and mixtures thereof. In selecting the composition of the melt, a composition having a hardness that is sufficient to protect the microcapsules from being ruptured during manufacture and handling is desirable.

Various additives may be added to the hot melt composition to make it suitable for application using an ink jet. For example, viscosity reducing agents may be added to the hot melt composition to provide the desired viscosity at the application temperature. Specific examples of viscosity reducing agents include stearamide, stearyl monoethanolamide stearate, and ethylene glycol distearate (EGDS). The viscosity reducing agent should be present in an amount to provide a viscosity of about 0.2 to 20 cps to the hot melt composition. Preferably, the viscosity reducing agent is present in an amount up to about 50% by weight of the hot melt composition. The specific amount of viscosity reducing agent used in a given hot melt composition depends on the specific hot melt composition employed and on the viscosity desired.

A hardening agent may also be used in the hot melt composition to provide the desired hardness to protect the microcapsules at room temperature. Useful hardening agents include ricinoleamides, hydroxystearamides, hydrogenated castor oil, esters of methylene glycol, esters of ethylene or propylene glycol, esters of glycerols, stearyl esters of 12-hydroxystearic acid, hydroxy acids such as 12-hydroxydodecanoic acid and derivatives thereof, and mixtures of the above. The hardening agent is used in the composition in an amount that renders the composition hard enough to protect the microcapsules from inadvertent rupture.

The hot melt compositions of the present invention are applied to the carbonless paper substrate by passing them through the nozzle or array of nozzles of an ink jet applicator system at an elevated temperature. The ink jet applicator can be of a conventional design provided that those parts of the applicator through which the molten composition is to flow are sufficiently heated and insulated so as to prevent the composition from solidifying within the applicator. One useful applicator is available from Dataproducts Corp.

The hot melt composition is fed to the ink jet applicator in solid or molten form. Typically, the composition is fed to the applicator as solid chips, granules or plugs and then melted in a suitable chamber or cartridge attached to or forming an integral part of the ink jet applicator. If desired, the hot melt composition can be contained in a separate heated reservoir and fed to one or more individual ink jet applicators through heated or insulated lines. As described above, the ink jet system deposits a plurality of spherical particles about 15 to 100 microns, preferably about 40 to 80 microns onto the carbonless paper substrate.

In applying the hot melt particles, it will be apparent that a variety of patterns and pitches can be used as long as the hot melt stilts are uniformly distributed over the surface of the substrate and protect the microcapsules from inadvertent rupture without interfering with rupturing the capsules in use by typing or writing.

The capsules are coated or spot printed onto the surface of the carbonless paper using conventional coating techniques and/or printing techniques either before or after the application of the hot melt stilts. By separating the application of the stilts from the application of the capsule coating, new application techniques which were previously unsuitable for the preparation of stilted carbonless papers can now be employed. Using ink jet printing, one can easily control the stilt size and placement of the stilts on the paper as contrasted with conventional techniques such as roll, air knife or blade coating or by any of the common printing processes such as off-set, gravure or flexographic printing.

Having described the invention in detail, it will be apparent that modifications and variations are possible without departing from the scope of the invention defined in the appended claims:

What is claimed is:

1. A method for preparing carbonless paper comprising forming molten particles of a hot melt composition, depositing said molten particles onto a substrate using an ink jet applicator such that said particles solidify and adhere to the substrate, and coating the substrate with a layer of capsules prior to or subsequent to depositing said molten particles on said substrate, said solidified particles being capable of functioning as a stilt material to protect said capsules from inadvertent rupture.

2. The method of claim 1 wherein said hot melt composition has a melting point of about 60° to 175° C. and a viscosity of about 0.2 to 20 cps when molten.

3. The method of claim 2 wherein said hot melt composition has a set up time of about 0.5 to 5 seconds.

4. The method of claim 3 wherein said hot melt composition has a set up time of about 0.5 to 2 seconds.

5. The method of claim 1 wherein said hot melt composition is a natural or synthetic resin, a high molecular weight organic compound having a functional group, a natural or synthetic wax, or mixtures thereof.

6. The method of claim 5 wherein said hot melt composition is sufficiently hard to prevent the microcapsules from being ruptured inadvertently during routine handling.

7. The method of claim 1 wherein said capsules are coated on said carbonless paper substrate prior to the application of said hot melt composition.

8. The method of claim 1 wherein said capsules are coated on said carbonless paper substrate subsequent to the application of said hot melt composition.

9. The method of claim 1 wherein said particles have a particle size of about 10 to 100 microns.

10. The method of claim 9 wherein said particles are applied on said carbonless transfer paper in a random or a patterned array.

11. The method of claim 1 wherein said capsules are spot printed on said substrate.

12. The method of claim 1 wherein said carbonless paper is a CB sheet, or a CFB sheet, or a self-contained sheet.

* * * * *